US006339980B1

(12) United States Patent
Woolf

(10) Patent No.: US 6,339,980 B1
(45) Date of Patent: Jan. 22, 2002

(54) PROTECTIVE TOOL COVER

(76) Inventor: Richard E. Woolf, 28 Ossulton Way, Hampstead Garden Suburb, London N2 0DS (GB)

( * ) Notice: Subject to any disclaimer, the term of this patent is extended or adjusted under 35 U.S.C. 154(b) by 0 days.

(21) Appl. No.: 09/512,682

(22) Filed: Feb. 25, 2000

(51) Int. Cl.[7] ..... B25B 13/58

(52) U.S. Cl. ..... 81/185.1; 81/185; 81/186; 81/421

(58) Field of Search ..... 81/185.1, 185, 81/186, 421, 422, 423

(56) References Cited

U.S. PATENT DOCUMENTS 2,766,649 A * 10/1956 Labry, Jr.

* cited by examiner

*Primary Examiner*—Timothy V. Eley
*Assistant Examiner*—Willie Berry, Jr.

(57) ABSTRACT

A protective tool cover for preventing damage to objects being worked upon with tools. The protective tool cover includes at least one cover member being adapted to cover the gripping and tool-working portions of a tool and also being made of plastic to substantially prevent certain objects from being scratched and dented during the use of the tool. A first embodiment of the cover member includes a pair of jaw-like end portions interconnected with a main portion and being fitted upon a wrench having jaw-like end portions. A second embodiment of the cover member includes a pair of cover members each having an object-gripping wall, end walls, an open side, and an open end and being fitting on the jaw-like portions of a pipe wrench. A third embodiment of the cover member includes a cylindrical member having a ratcheted outer surface and a ratcheted inner surface and being insertable in a socket.

5 Claims, 3 Drawing Sheets

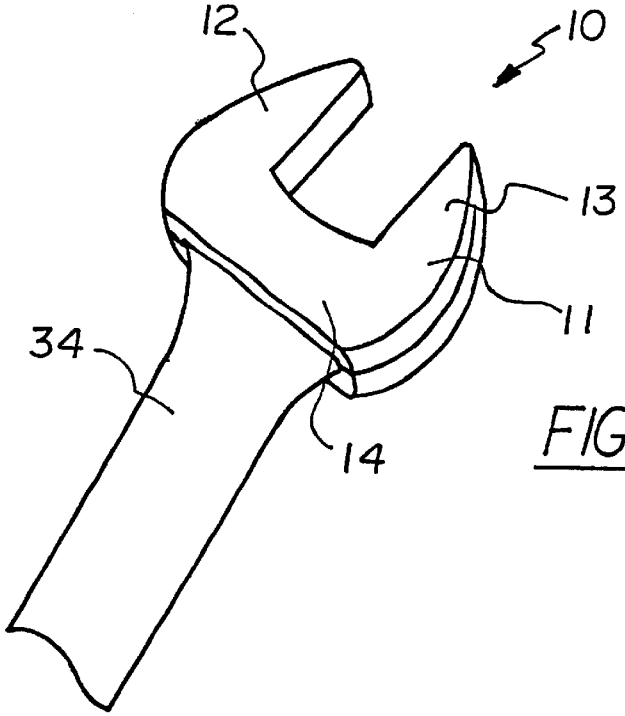
FIG. 1
FIG. 2
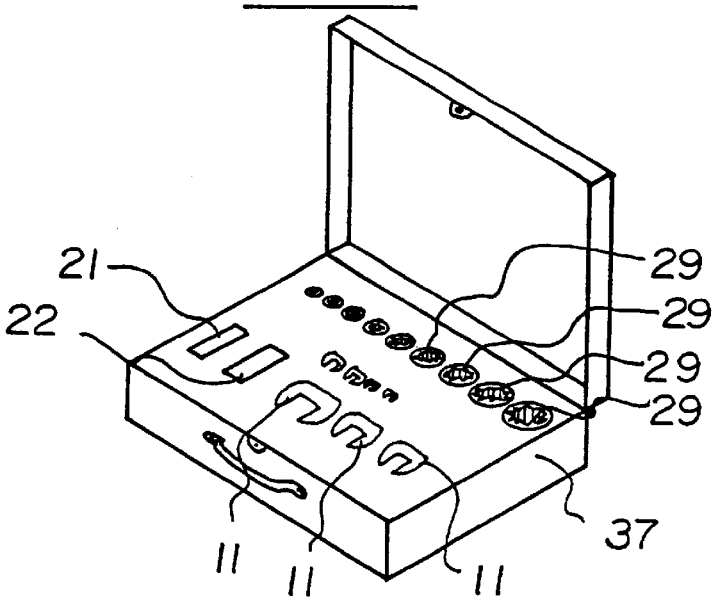
FIG. 3
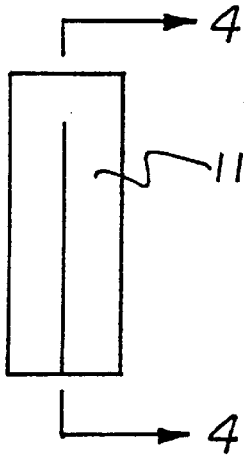

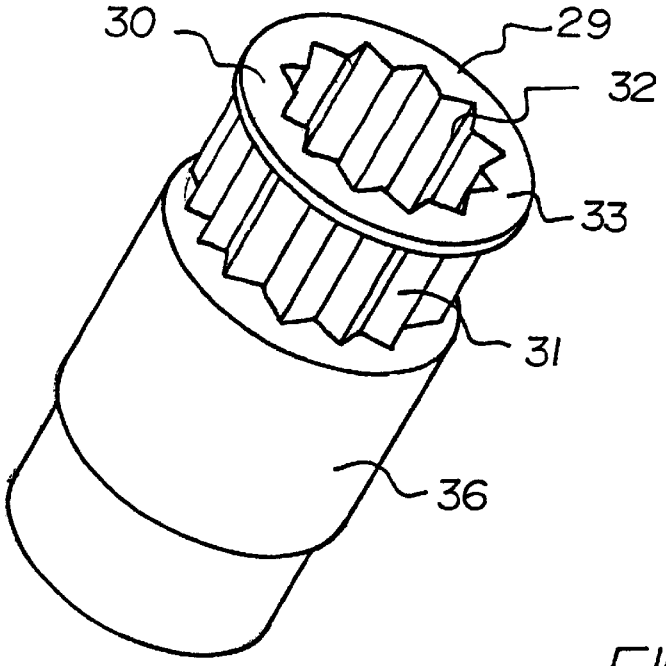
FIG. 6
FIG. 7
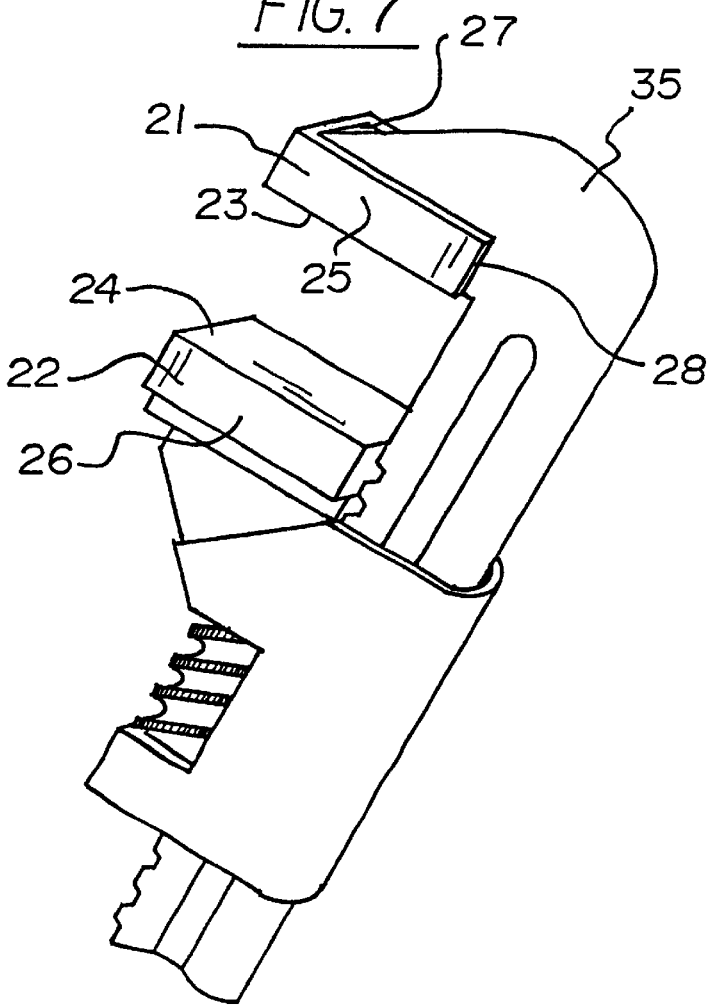

PROTECTIVE TOOL COVER

BACKGROUND OF THE INVENTION

1. Field of the Invention

The present invention relates to tool cover for protecting objects to which the tool is being applied and more particularly pertains to a new protective tool cover for preventing damage to objects being worked upon with tools.

2. Description of the Prior Art

The use of tool cover for protecting objects to which the tool is being applied is known in the prior art. More specifically, tool cover for protecting objects to which the tool is being applied heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,905,550; U.S. Pat. No. 4,836,067; U.S. Pat. No. 4,979,355; U.S. Pat. No. 4,252,305; U.S. Pat. No. 4,315,447; and U.S. Pat. No. Des. 340,851.

While these devices fulfill their respective, particular objectives and requirements, the aforementioned patents do not disclose a new protective tool cover. The inventive device includes at least one cover member being adapted to cover the gripping and tool-working portions of a tool and also being made of plastic to substantially prevent certain objects from being scratched and dented during the use of the tool. A first embodiment of the cover member includes a pair of jaw-like end portions interconnected with a main portion and being fitted upon a wrench having jaw-like end portions. A second embodiment of the cover member includes a pair of cover members each having an object-gripping wall, end walls, an open side, and an open end and being fitting on the jaw-like portions of a pipe wrench. A third embodiment of the cover member includes a cylindrical member having a ratcheted outer surface and a ratcheted inner surface and being insertable in a socket.

In these respects, the protective tool cover according to the present invention substantially departs from the conventional concepts and designs of the prior art, and in so doing provides an apparatus primarily developed for the purpose of preventing damage to objects being worked upon with tools.

SUMMARY OF THE INVENTION

In view of the foregoing disadvantages inherent in the known types of tool cover for protecting objects to which the tool is being applied now present in the prior art, the present invention provides a new protective tool cover construction wherein the same can be utilized for preventing damage to objects being worked upon with tools.

The general purpose of the present invention, which will be described subsequently in greater detail, is to provide a new protective tool cover apparatus and method which has many of the advantages of the tool cover for protecting objects to which the tool is being applied mentioned heretofore and many novel features that result in a new protective tool cover which is not anticipated, rendered obvious, suggested, or even implied by any of the prior art tool cover for protecting objects to which the tool is being applied, either alone or in any combination thereof.

To attain this, the present invention generally comprises at least one cover member being adapted to cover the gripping and tool-working portions of a tool and also being made of plastic to substantially prevent certain objects from being scratched and dented during the use of the tool. A first embodiment of the cover member includes a pair of jaw-like end portions interconnected with a main portion and being fitted upon a wrench having jaw-like end portions. A second embodiment of the cover member includes a pair of cover members each having an object-gripping wall, end walls, an open side, and an open end and being fitting on the jaw-like portions of a pipe wrench. A third embodiment of the cover member includes a cylindrical member having a ratcheted outer surface and a ratcheted inner surface and being insertable in a socket.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new protective tool cover apparatus and method which has many of the advantages of the tool cover for protecting objects to which the tool is being applied mentioned heretofore and many novel features that result in a new protective tool cover which is not anticipated, rendered obvious, suggested, or even implied by any of the prior art tool cover for protecting objects to which the tool is being applied, either alone or in any combination thereof.

It is another object of the present invention to provide a new protective tool cover which may be easily and efficiently manufactured and marketed.

It is a further object of the present invention to provide a new protective tool cover which is of a durable and reliable construction.

An even further object of the present invention is to provide a new protective tool cover which is susceptible of a low cost of manufacture with regard to both materials and labor, and which accordingly is then susceptible of low prices of sale to the consuming public, thereby making such protective tool cover economically available to the buying public.

Still yet another object of the present invention is to provide a new protective tool cover which provides in the apparatuses and methods of the prior art some of the advantages thereof, while simultaneously overcoming some of the disadvantages normally associated therewith.

Still another object of the present invention is to provide a new protective tool cover for preventing damage to objects being worked upon with tools.

Yet another object of the present invention is to provide a new protective tool cover which includes at least one cover member being adapted to cover the gripping and tool-working portions of a tool and also being made of plastic to substantially prevent certain objects from being scratched and dented during the use of the tool. A first embodiment of the cover member includes a pair of jaw-like end portions interconnected with a main portion and being fitted upon a wrench having jaw-like end portions. A second embodiment of the cover member includes a pair of cover members each having an object-gripping wall, end walls, an open side, and an open end and being fitting on the jaw-like portions of a pipe wrench. A third embodiment of the cover member includes a cylindrical member having a ratcheted outer surface and a ratcheted inner surface and being insertable in a socket.

Still yet another object of the present invention is to provide a new protective tool cover that is easy and convenient to install and fit upon the gripping portions of a tool.

Even still another object of the present invention is to provide a new protective tool cover that allows the user to work with an object without the object being damaged in some fashion.

These together with other objects of the invention, along with the variou's features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the first embodiment of a new protective tool cover according to the present invention.

FIG. 2 is a perspective view of various protective tool covers stored in a carrying case.

FIG. 3 is a side elevational view of the first embodiment of the present invention.

FIG. 6 is a perspective view of the third embodiment of the present invention.

FIG. 7 is a perspective view of the second embodiment of the present invention.

DESCRIPTION OF THE PREFERRED EMBODIMENT

Figure 5:
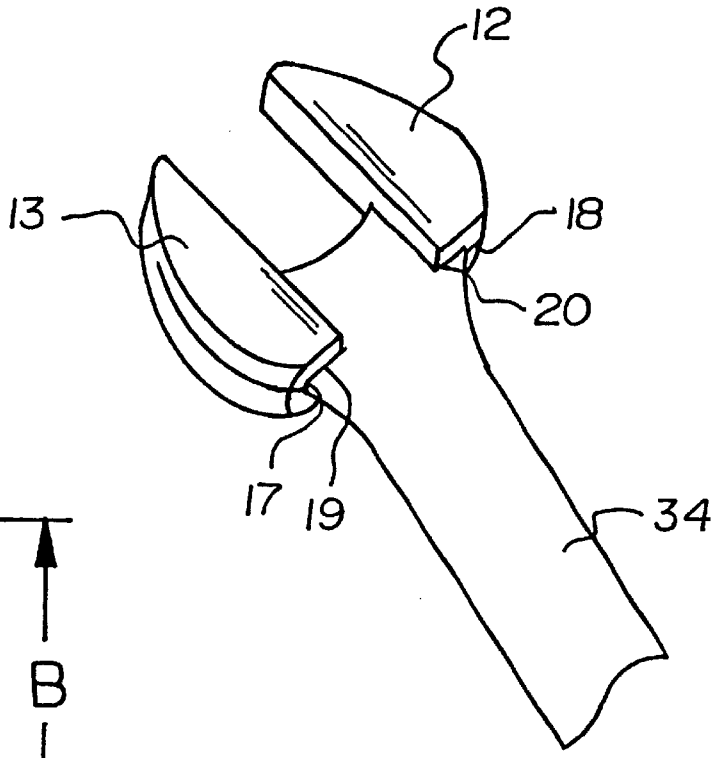
FIG. 5 is a another perspective view of the first embodiment of the present invention.
Figure 4:
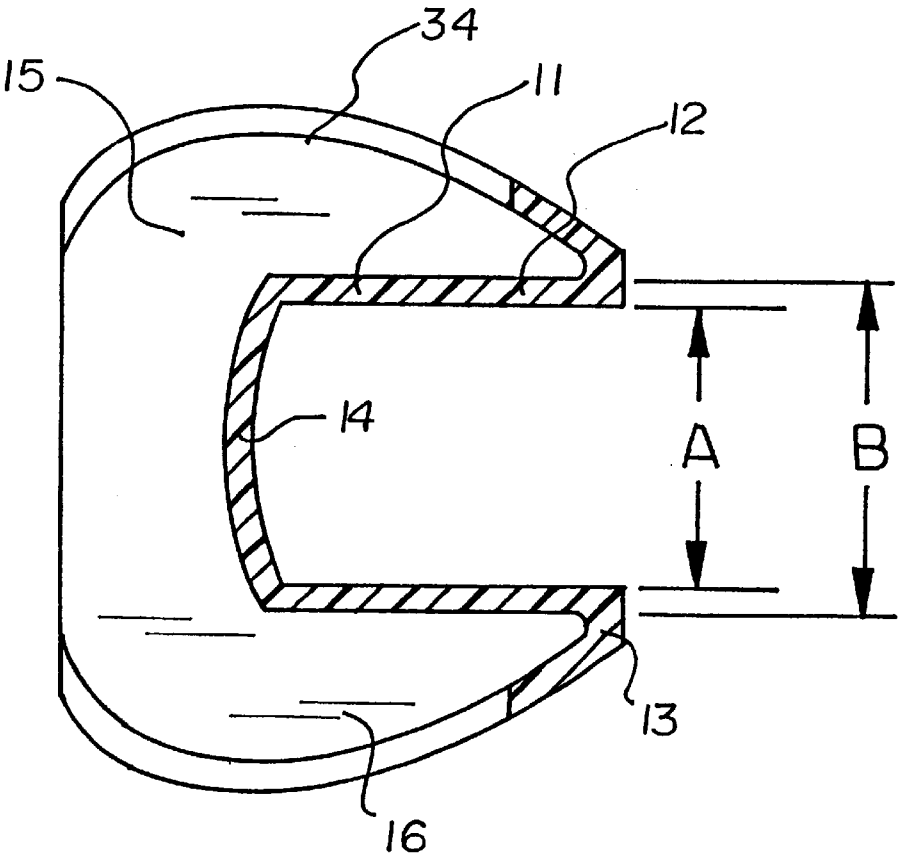
FIG. 4 is a cross-sectional view of the first embodiment of the present invention.

With reference now to the drawings, and in particular to FIGS. 1 through 7 thereof, a new protective tool cover embodying the principles and concepts of the present invention and generally designated by the reference numeral 10 will be described.

As best illustrated in FIGS. 1 through 7, the protective tool cover 10 generally comprises at least one cover member 11,21,22,29 being adapted to removably cover a gripping and tool-working portions of a tool 34,35,36. The cover member 11,21,22,29 is adapted to retain the structure of the gripping and tool-working portions of the tool 34,35,36 with the cover member 11,21,22,29 being made of plastic to essentially prevent scratching and denting of objects to which a tool 34,35,36 is being applied.

As a first embodiment, the cover member 11 includes a pair of jaw-like end portions 12,13 and a main portion 14 which integrally interconnects the jaw-like end portions 12,13. The jaw-like end portions 12,13 are disposed parallel to one another and are spaced apart thus forming an object-receiving slot therebetween. Each of the jaw-like end portions 12,13 has side and end walls and has an internal cavity 15,16 and has a bottom end 17,18 which has an opening 19,20 extending in the internal cavity 15,16. The opening 19,20 and the internal cavity 15,16 are adapted to receive a jaw-like end portion of a wrench 34 with the object-receiving slot being adapted to reduce the fittings of the wrench by 34 one size.

As a second embodiment, the protective tool cover 10 includes a pair of cover members 21,22 each having an object-gripping wall 23,24, end walls 25,26, an open side 27 and an open end 28 and being adapted to securely fit about a jaw-like portion of a wrench 35 such as a pipe wrench. Each of the pair of cover members 21,22 is adapted to securely fit about a respective jaw-like portion of a pipe wrench 35.

As a third embodiment, the protective tool cover 10 comprises a cover member 29 including a cylindrical body 30 having a ratcheted outer surface 31, a ratcheted inner surface 32 and an annular flange 33 securely and conventionally disposed at an outer end of the cylindrical body 30. The cylindrical body 30 is adapted to be securely received in a tool 36 such as a socket.

In use, the user places the protective tool covers 10 upon the respective tools 34,35,36 and uses the tool as usual by gripping and engaging the selected objects such as nuts, bolts, door handles, and plumbing fixtures with the objects being scratched or dented in any fashion. The protective tool cover 10 can be made of various sizes and can be stored in a carrying case 37.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A protective tool cover for a tool having a pair of jaw portions, the jaws having opposing jaw faces spaced a predetermined distance from each other, each of said jaws having a rear surface, said tool cover comprising:

a cover member being adapted to removably cover a jaw portion of a tool;

said cover member further comprising a pair of jaw-like end portions and a main portion interconnecting said jaw-like end portions, said main portion holding said jaw-like end portions in a parallel relationship to one another, said jaw-like end members defining secondary jaw faces on said jaw-like end portions which form an object-receiving slot therebetween;

said jaw-like end portions each having side and end walls and having an internal cavity, each of said jaw-like end portions having a bottom end with an opening extending in said internal cavity, said opening and said internal cavity being adapted to receive said jaw portion of said tool, said object-receiving slot being adapted to reduce a size of the object-receiving slot of said tool by one tool size.

2. A protective tool cover as described in claim 1, wherein said cover member is made of plastic to essentially prevent scratching and denting of objects to which a tool is being applied.

3. A protective tool cover as described in claim 2, wherein said at least one cover member includes a pair of jaw-like end portions and a main portion which interconnects said jaw-like end portions, said jaw-like end portions being disposed parallel to one another and being spaced apart thus forming an object-receiving slot therebetween, each of said jaw-like end portions having side and end walls and having an internal cavity and having a bottom end which has an opening extending in said internal cavity, said opening and said internal cavity being adapted to receive a jaw-like end portion of a wrench, said object-receiving slot being adapted to reduce the fittings of the wrench by one size.

4. A protective tool cover as described in claim 3, wherein said at least one cover member includes a pair of cover members each having an object-gripping wall, end walls, an open side and an open end and being adapted to securely fit about a jaw-like portion of a wrench such as a pipe wrench, said pair of cover members each being adapted to securely fit about a respective jaw-like portion of a pipe wrench.

5. A protective tool cover as described in claim 3, wherein said at least one cover member includes a cylindrical body having a ratcheted outer surface, a ratcheted inner surface and an annular flange securely disposed at an outer end of said cylindrical body, said cylindrical body being adapted to be securely received in tool such as a socket.

* * * * *